US010724797B2

(12) United States Patent
Liu et al.

(10) Patent No.: US 10,724,797 B2
(45) Date of Patent: Jul. 28, 2020

(54) CONTINUOUS LOW OXYGEN AND HIGH TEMPERATURE COMBUSTION ALUMINUM MELTING FURNACE WITH POROUS INJECTION PIPE HEAT EXCHANGER

(71) Applicant: Guangdong University of Technology, Guangzhou (CN)

(72) Inventors: Xiaozhou Liu, Guangzhou (CN); Yu Zhang, Guangzhou (CN); Wenxing Liu, Guangzhou (CN)

(73) Assignee: Guangdong University of Technology, Guangzhou (CN)

( * ) Notice: Subject to any disclaimer, the term of this patent is extended or adjusted under 35 U.S.C. 154(b) by 0 days.

(21) Appl. No.: 15/746,333

(22) PCT Filed: May 12, 2016

(86) PCT No.: PCT/CN2016/081929
§ 371 (c)(1),
(2) Date: Jan. 19, 2018

(87) PCT Pub. No.: WO2017/084254
PCT Pub. Date: May 26, 2017

(65) Prior Publication Data

US 2018/0224208 A1 Aug. 9, 2018

(30) Foreign Application Priority Data

Nov. 19, 2015 (CN) ..... 2015 1 0807710

(51) Int. Cl.
*F27B 14/14* (2006.01)
*C22B 21/00* (2006.01)
*F27D 17/00* (2006.01)

(52) U.S. Cl.
CPC ..... *F27B 14/143* (2013.01); *C22B 21/0084* (2013.01); *F27B 2014/146* (2013.01); *F27D 2017/007* (2013.01)

(58) Field of Classification Search
CPC ..... F27B 14/143
See application file for complete search history.

(56) References Cited

U.S. PATENT DOCUMENTS 3,756,489 A * 9/1973 Chartet ..... B23K 1/008 228/43
4,610,390 A * 9/1986 Takahashi ..... B23K 35/3605 148/23

(Continued)

FOREIGN PATENT DOCUMENTS

CN 102252340 A 11/2011
CN 202074556 U 12/2011

(Continued)

OTHER PUBLICATIONS

International Search Report for PCT/CN2016/081929, dated Aug. 25, 2016 (5 pgs).

*Primary Examiner* — Nathaniel Herzfeld
(74) *Attorney, Agent, or Firm* — Bradley J. Thorson

(57) ABSTRACT

A continuous aluminum melting furnace with a porous spray pipe heat exchanger, comprising a furnace body, combustion nozzles, a smoke pipeline and a heat exchanger. The heat exchanger comprises a smoke channel and heat exchange cylinders, wherein each of the heat exchange cylinders comprises a head end, a tail end, and a porous spray pipe in at least one of the cylinders. The porous spray pipe comprises a closed end and a pipe body, with several air spray holes provided on a peripheral wall of the pipe body so that cold air entering the at least one heat exchange cylinder is sprayed to an inner wall of the cylinder so as to exchange heat with high-temperature smoke which flows through an (Continued)

outer wall of the cylinder, thus keeping the temperature of the cylinder lower than the rated tolerant temperature of the material from which the cylinder is made.

6 Claims, 2 Drawing Sheets

(56) References Cited

U.S. PATENT DOCUMENTS

| | | | | |
|---|---|---|---|---|
| 5,021,087 | A * | 6/1991 | Morton | C22B 21/064<br>75/678 |
| 2009/0136884 | A1 * | 5/2009 | Jepson | C21D 1/52<br>432/14 |

FOREIGN PATENT DOCUMENTS

| | | | |
|---|---|---|---|
| CN | 104315866 | A | 1/2015 |
| CN | 105222585 | A | 1/2016 |
| CN | 105423753 | A | 3/2016 |
| CN | 205279729 | U | 6/2016 |
| JP | H06257951 | A | 9/1994 |

* cited by examiner

CONTINUOUS LOW OXYGEN AND HIGH TEMPERATURE COMBUSTION ALUMINUM MELTING FURNACE WITH POROUS INJECTION PIPE HEAT EXCHANGER

RELATED APPLICATIONS

The present application is a National Phase entry of PCT Application No. PCT/CN2016/081929, filed May 12, 2016, which claims priority to CN 201510807710, filed Nov. 19, 2015, all said applications being hereby incorporated herein by reference in their entireties.

BACKGROUND OF THE INVENTION

Field of the Invention

The present invention relates to furnace equipment, especially to an aluminum melting furnace.

Description of the Related Art

In view of the increasingly urgent environmental problems and energy crisis, energy saving and emission reduction are vigorously promoted all over the world, especially for industrial furnace related fields with huge energy consumption and serious pollution. How to achieve energy-saving and emission reduction goals has become the factor that technicians in the field must consider in designing such kind of equipment.

Taking aluminum melting furnaces for example, the temperature of the flue gas at the flue gas outlet may typically reaches to about 1000-1100° C. If such high temperature flue gas is exhausted to the ambient environment without further treatment, not only energy waste but also certain level of damage will be caused to the environment. Therefore, the person in the field have been continuously searched for novel technology to reduce the temperature of the furnace flue gas, such as re-inducing the discharged flue gas into the furnace for re-combustion, or using heat exchangers in the flue gas discharge process, in order to take use of the waste heat of the flue gas. The above-mentioned measures have achieved maximum utilization of the flue gas energy, while reducing the temperature of the flue gas, thus saving energy and reducing emission pollution. In the existing waste heat recycling technology, heat exchangers made of stainless steel or carbon steel are typically provided. However, since stainless steel is relative expensive and has limited application scope; in contrast, carbon steel is not able to stand high temperature, thus the heat exchangers that are made of carbon steel will have to be switched between several heat exchangers or heat accumulation chambers, causing a complex system structure, high cost and maintain difficulty.

As disclosed in China Patent Publication No. 103123241A, an air preheater for aluminum melting furnace is comprised of silicon carbide material and an air preheater heat transferring steel pipe, with silicon carbide material lining the inner wall of the air preheater heat transferring steel pipe. To avoid burnout of the air preheater, the inner wall of the air preheater heat transferring steel pipe is lined with silicon carbide material, causing manufacture cost rising.

As disclosed in China Patent Publication No. 2035505570U, a combustion system with fast switching heat accumulation aluminum melting furnace is comprised of a furnace body, a first and a second fuel nozzles, a first and a second vent pipes, a first and a second heat reservoirs, and a first and a second inlet pipes. Wherein the first and second heat reservoirs are operate alternatively by switching between preheating state and heat accumulating state. In addition, the first and/or second heat reservoir is comprised of a first stage heat accumulating area, a second stage heat accumulating area and a precipitation area provided between the first and second stage heat accumulating area. To avoid damage to the heat reservoirs, two alternatively operated heat reservoirs are provided in such combustion system, increasing construction cost.

Therefore, all the above-mentioned technologies utilize heat exchangers to transfer heat between high temperature flue gas and air, preheating the air with the waste heat of the flue gas. However, such technologies have some drawbacks or deficiencies as follows, for example: (1) A pair of combustors and a pair of heat reservoirs that correspond to the pair of combustor are provided on two sides of the furnace body. When the temperature of the combustor and heat reservoir located on one side is too high, the combustor and heat reservoir located on the other side will be switched on. However, it is required to stop running the devices in such switching process, causing discontinuous combustion and high power consumption; (2) The heat exchange rate of the above heat transfer mode is insufficient to achieve satisfactory heat exchange effects. In particular, as for aluminum melting furnaces, since the temperature of the discharged flue gas may be up to 1000-1100° C., neither the structure nor the operating mode of the above heat exchangers can meet the requirement of effectively reducing the flue gas temperature. Thus, the heat exchangers tend to be overheated. Especially for those heat exchangers that are made of carbon steel, they are unable to stand such high flue gas temperature, causing potential safety hazard; (3) The content of nitrogen oxide in the discharged flue gas is so high that it may cause damage to the environment.

Therefore, it is in urgent need in the field to provide an aluminum melting furnace waste heat utilization system that is able to take full use of flue gas waste heat and achieve the effective heat exchange between high temperature flue gas and air.

SUMMARY OF THE INVENTION

The present invention aims to provide a continuous low oxygen and high temperature combustion aluminum melting furnace that is capable of significantly improving heat exchanging efficiency and avoiding heat exchanger overheat.

The term "calibration heat-resisting temperature" used herein means the temperature under which a material is able to function stably and durably over time.

Generally, the calibration heat-resisting temperature of carbon steel is about 350° C. The maximum operating temperature for carbon steel is about 450° C., over which temperature carbon steel will be graphitized, reducing the strength of the steel to too low to meet usage requirements. Therefore, although carbon steel is with low cost and good technological properties (for example, weldability and cold formability), it is not applicable in producing typical aluminum melting furnace high temperature heat exchangers.

While as for stainless steel, the calibration heat-resisting temperature is about 525° C. in generally, some special stainless steel may have even higher heat-resisting temperature, for example, Stainless Steel 301 or 304 may have a heat-resisting temperature of 870° C. However, stainless steel material is expensive and poor in technological performance. In the condition that stainless steel is used to make aluminum melting furnace high temperature heat exchangers, service life will be shortened under a high temperature condition of 1000° C.

A porous injection pipe heat exchanger with special construction is provided in the present invention. Such heat exchangers are made of common carbon steel yet still durable over time.

According to one aspect of the present invention, a continuous low oxygen and high temperature combustion aluminum melting furnace with porous injection pipe heat exchanger is provided, comprising: a furnace body, which is comprised of an aluminum melting tank provided inside the furnace body, a combustion chamber provided inside the furnace body and above the aluminum melting tank, and a first high temperature flue gas outlet that is located on one end wall of the furnace body and connected to the combustion chamber; at least one combustion nozzle provided on the other end wall of the furnace body for injecting fuel and combustion-supporting gas into the combustion chamber, in order to release the heat generated in the combustion and melt the aluminum in the aluminum melting tank into molten aluminum; a flue gas piping connected the first high temperature flue gas outlet of the furnace body to a chimney; and a high temperature heat exchanger provided in the flue gas piping to make use of the waste heat of the flue gas for preheating air. Wherein the high temperature heat exchanger is a porous injection pipe heat exchanger comprised of a flue gas passage and at least one heat-exchanging cylinder that is provided in the flue gas passage. The at least one heat-exchanging cylinder is comprised of a head end that formed into circular end wall and with an intake hole in the center, a tail end that formed into open end, and a porous injection pipe that extends around the intake hole from the head end to the tail end in the at least one heat-exchanging cylinder, wherein cold air enters the porous injection pipe heat exchanger through the intake hole and the preheated high temperature air flows out of the porous injection pipe heat exchanger through the tail end, and the porous injection pipe is comprised of a closed end that is adjacent to the tail end and a pipe body that extends between the intake hole and the closed end, several air apertures are provided on the periphery wall of the pipe body, such that the cold air that enters the at least one heat-exchanging cylinder through the intake hole is injected towards the inner wall of the at least one heat-exchanging cylinder through the several air apertures, in order to conduct fast heat exchange with the high temperature flue gas that flows along the outer wall of the at least one heat-exchanging cylinder and maintain the temperature of the at least one heat-exchanging cylinder below the calibration heat-resisting temperature of the manufacturing material thereof.

Preferably, the porous injection pipe heat exchanger is comprised of a first heat-exchanging cylinder, a second heat-exchanging cylinder and a third heat-exchanging cylinder which are provided in the flue gas passage in sequence along the flue gas flowing direction, the porous injection pipe heat exchanger is also comprised of a first connecting passage and a second connecting passage which are provided outside the flue gas passage, the first heat-exchanging cylinder is connected to the third heat-exchanging cylinder end to end along the air flowing direction by the first connecting passage, and the third heat-exchanging cylinder is connected to the second heat-exchanging cylinder end to end along the air flowing direction by the second connecting passage, wherein the cold air enters the first heat-exchanging cylinder through the intake hole of the first heat-exchanging cylinder and then passes the first connecting passage, the third heat-exchanging cylinder, the second connecting passage and the second heat-exchanging cylinder, the preheated high temperature air flows out through the tail end of the second heat-exchanging cylinder.

Optionally, the porous injection pipe heat exchanger is further comprised of an intake chamber that is provided outside the flue gas passage and is connected to the head end of the first heat-exchanging cylinder and an outtake chamber that is provided outside the flue gas passage and is connected to the tail end of the second heat-exchanging cylinder, a low temperature air inlet of the porous injection pipe heat exchanger is formed on the chamber wall of the intake chamber, a high temperature air outlet of the porous injection pipe heat exchanger is formed on the chamber wall of the outtake chamber, a high temperature flue gas inlet is formed on one end of the flue gas passage of the porous injection pipe heat exchanger that is adjacent to the first heat-exchanging cylinder, and a low temperature flue gas outlet is formed on one end of the flue gas passage of the porous injection pipe heat exchanger that is adjacent to the third heat-exchanging cylinder.

Optionally, a dust-removing and heat-exchanging chamber is provided in the flue gas piping and upstream of the porous injection pipe heat exchanger along the flue gas flowing direction, the dust-removing and heat-exchanging chamber is comprised of a dust-contained flue gas inlet and a dust-removed flue gas outlet which are spaced on the top portion, the dust-contained flue gas inlet is connected to the first high temperature flue gas outlet of the furnace body, and the dust-removed flue gas outlet is connected to the high temperature flue gas inlet of the porous injection pipe heat exchanger.

Optionally, the dust-removing and heat-exchanging chamber is made of heat-resisting material (such as ceramic or brick), or formed by digging the ground downwards directly to create a dust-removing space and then installing a roof thereon.

Preferably, a high pressure fan is further provided for delivering pressurized cold air into the porous injection pipe heat exchanger. For example, the pressure of the cold air delivered by the high pressure fan is set to be as high as about 2 times of the standard atmospheric pressure, such as 3 times of the standard atmospheric pressure, so as to conduct heat exchange by injecting the cold air in the heat exchanger in a fast and efficient way, and facilitate the injecting in the mixer.

Optionally, the furnace body is further comprised of a second high temperature flue gas outlet that is provided on the side wall and connected to the combustion chamber, the continuous low oxygen and high temperature combustion aluminum melting furnace with porous injection pipe heat exchanger is also comprised of a mixer, the mixer is comprised of a high temperature air inlet, a back-flow flue gas inlet, and a mixed gas outlet, the back-flow flue gas inlet is connected to the second high temperature flue gas outlet of the furnace body by conduits, the high temperature air inlet is connected to the high temperature air outlet of the porous injection pipe heat exchanger by conduits, and the mixed gas outlet is connected to the at least one combustion nozzle by conduits, in order to deliver the mixed gas containing high temperature air and high temperature flue gas into the at least one combustion nozzle as combustion-supporting gas.

Preferably, the mixer is also comprised of an injecting pipe that extends inwards from the high temperature air inlet, the mixer injects a part of the high temperature flue gas into the mixer through the second high temperature flue gas with the action of the negative pressure generated by the high temperature air injected by the injecting pipe.

Wherein the volume ratio of the high temperature flue gas flew out from the first high temperature flue gas outlet of the furnace body to that flew out from the second high temperature flue gas outlet in unit time is set to be 2-10:1, for example, 4:1.

Optionally, two combustion nozzles are provided on the other end wall of the furnace body at intervals.

Optionally, at least one heat-exchanging cylinder is made of carbon steel.

Preferably, when the pipe wall of the porous injection pipe is flatten, the several air apertures will be provided across the whole pipe wall in matrix.

Wherein, the temperature of the high temperature flue gas in the furnace body is about 1000-1200° C., and the oxygen content thereof is about 2%-5% in volume. The temperature of the flue gas entered the porous injection pipe is about 800-1000° C., the temperature of the flue gas discharged from the porous injection pipe heat exchanger is about 120-180° C. The temperature of the air entered the mixer from the porous injection pipe heat exchanger is about 600-800° C. The temperature of the mixed gas flew out of the mixer is about 800-1000° C., and the oxygen content thereof is about 10%-13% in volume.

Optionally, at least one heat-exchanging cylinder is provided in the flue gas passage of the porous injection pipe heat exchanger along a direction that is perpendicular to the flue gas flowing direction.

Furthermore, suitable number of the heat-exchanging cylinder and connecting passage could be selected based on actual needs to achieve expected heat-exchanging effects, for example, 5 heat-exchanging cylinders and 4 connecting passages, or 6 heat-exchanging cylinders and 5 connecting passages.

Optionally, the porous injection pipe heat exchanger can be comprised of only one heat-exchanging cylinder that is provided in the flue gas passage. The head end of the heat-exchanging cylinder is formed into the low temperature air inlet directly, and the tail end of the heat-exchanging cylinder is formed into the high temperature air outlet directly.

Optionally, the porous injection pipe heat exchanger can be comprised of two or more heat-exchanging cylinders that are provided in the flue gas passage.

Optionally, the fuel gas utilized in the present invention can be natural gas, coal gas or liquefied petroleum gas.

The beneficial effects of the present invention are as follows: (1) Since the ambient air is pressurized by the high pressure fan before entering the porous injection pipe heat exchanger and the hole of the air apertures are small, after entering the porous injection pipe, the high pressure air will be injected outwards from the porous injection pipe through the air apertures under high speed and high pressure and then impact the inner wall of the heat-exchanging cylinder under such high speed and high pressure, the high speed and high pressure impact will ensure the quick and efficient heat exchange between the low temperature air inside the heat-exchanging cylinder and the high temperature flue gas outside the heat-exchanging cylinder, reducing the temperature of the flue gas quickly. For example, provided that the temperature of the flue gas that entered the porous injection pipe heat exchanger is about 900° C., it is also ensured that the components of the porous injection pipe heat exchanger are kept in acceptable temperature range. Especially for the porous injection pipe heat exchangers that are made of carbon steel, it is possible to meet the requirements for temperatures, prolong the service life of the porous injection pipe heat exchanger, and reduce cost and ensure operation security. While as for porous injection pipe heat exchangers that are made of stainless steel, service life is prolonged significantly and the workload of maintenance and replacement are reduced; (2) The above-mentioned fast and efficient heat exchanging process can improve the waste heat utilization effect of the high temperature flue gas from the aluminum melting furnace obviously, conduct the waste heat utilization of the high temperature flue gas in a short time period, save energy and reduce environmental pollution; (3) Since the porous injection pipe heat exchanger is structured to ensure that the system components are operated in acceptable temperature range all the time, it is unnecessary to switch between several heat-exchanging systems or heat accumulation systems, ensuring the continuity of the combustion process, simplifying the system structure and reducing difficulties of components construction; (4) The flowing direction of the flue gas that is heat exchanged in the porous injection pipe heat exchanger is perpendicular to that of the air, with the action of the flue gas impact on the pipe wall of the air passage, the heat exchanging effect between the flue gas and the air is enhanced by the greatest degree; (5) Re-inducing a part of the flue gas discharged from the furnace body to the mixer to make it fully mixed with the air that is preheated by the porous injection pipe heat exchanger in the mixer for re-combustion can reduce the oxygen content of the mixed gas, achieving low oxygen combustion in the furnace body and reducing the pollution to the environment since the low nitrogen oxide content in the combustion products; (6) Two combustion nozzles are spaced on the furnace body of the aluminum melting furnace, increasing melting speed and saving energy; (7) The air first enters the first heat-exchanging cylinder that is located in the forward portion of the flue gas passage for heat exchange, then enters the third heat-exchanging cylinder that is located in the backward portion of the flue gas passage for heat exchange, and finally enters the second heat-exchanging cylinder that is located in the middle portion of the flue gas passage for heat exchange, such construction makes the heat exchanging process between the air and the flue gas more efficient and rational, reducing the temperature of the flue gas that is discharged into the atmosphere; (8) A part of the high temperature fuel gas is suctioned into the mixer by the negative pressure caused by the injecting effect of the high pressure air in the mixer, so as to clear the furnace pressure, avoiding potential safety hazard caused by the furnace pressure increase in the aluminum melting furnace.

DETAILED DESCRIPTION OF THE INVENTION

Figure 1:
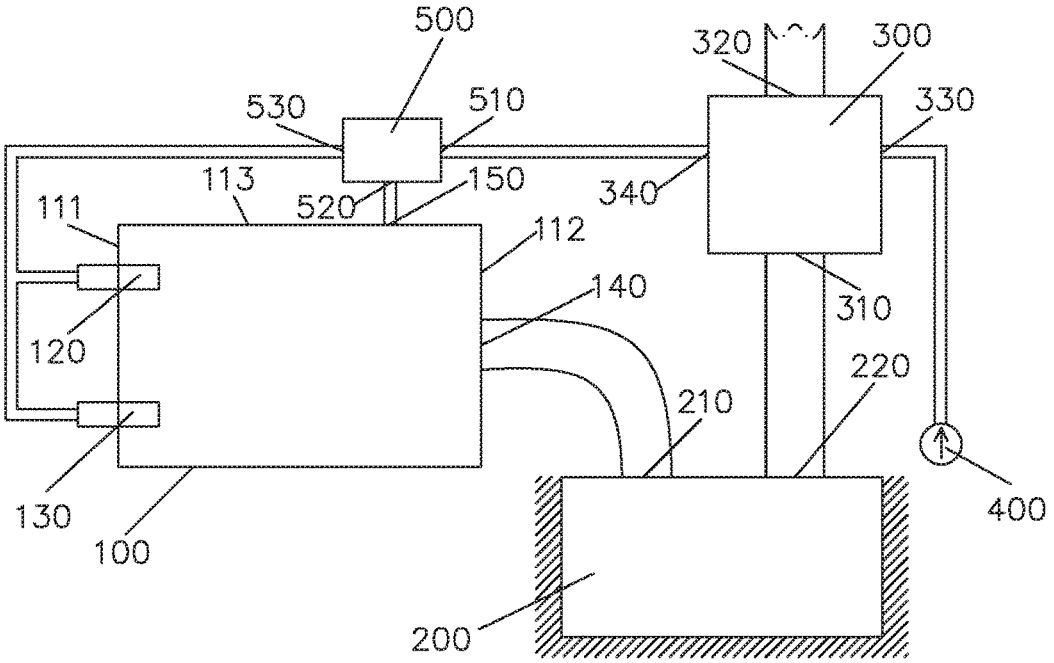
FIG. 1 shows the constructional illustration of the continuous low oxygen and high temperature combustion aluminum melting furnace with porous injection pipe heat exchanger according to the present invention.
Figure 2:
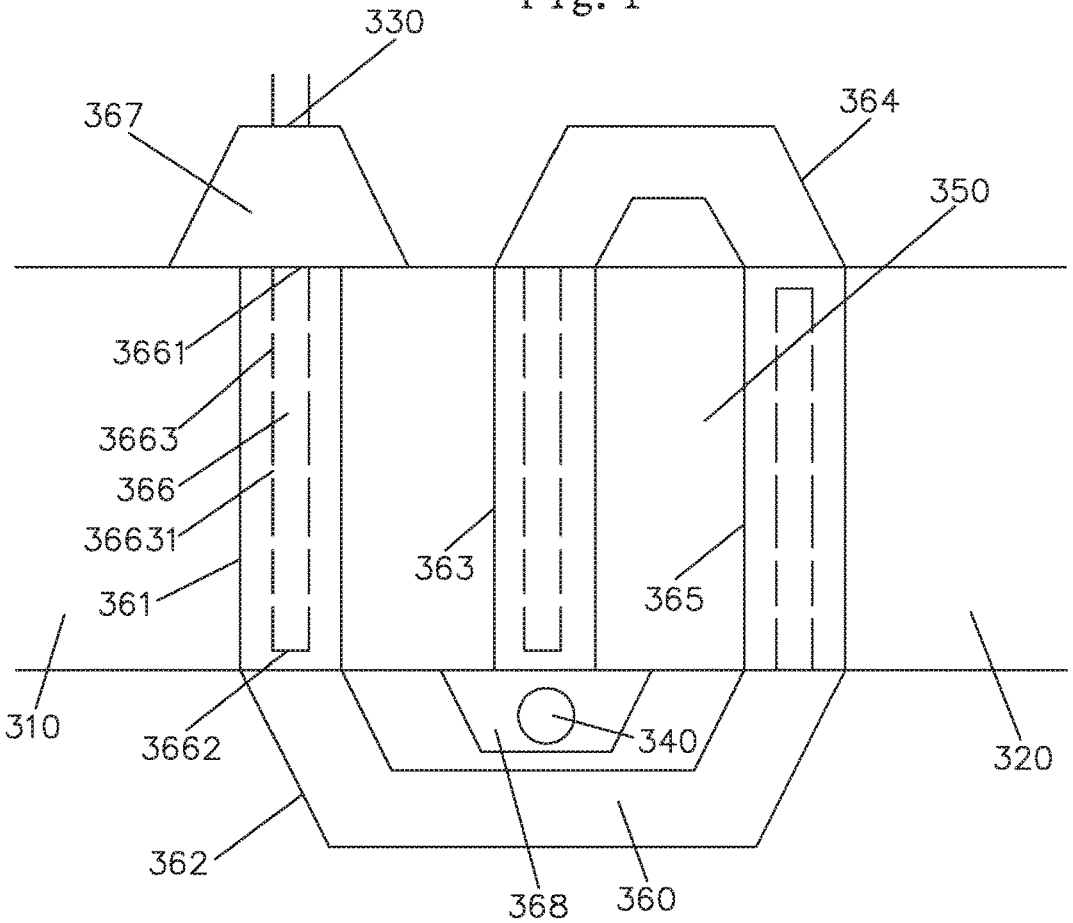
FIG. 2 shows the constructional illustration of the porous injection pipe heat exchanger according to the present invention.

Now refer to FIGS. 1 and 2, according to one embodiment of the present invention, a continuous low oxygen and high temperature combustion aluminum melting furnace with porous injection pipe heat exchanger is comprised of a furnace body 100, a dust-removing and heat-exchanging chamber 200, a porous injection pipe heat exchanger 300, a high pressure fan 400 and a mixer 500.

The furnace body 100 comprises a first combustion nozzle 120 and a second combustion nozzle 130, which are spaced on one end wall 111 of the furnace body 100. A first high temperature flue gas outlet 140 is provided on the other end wall 112 of the furnace body 100. A second high temperature flue gas outlet 150 is provided on one side wall 113 of the furnace body 100. In operation, the first combustion nozzle 120 and the second combustion nozzle 130 are used to inject fuel and combustion-supporting gas into the furnace chamber of the furnace body 100 for combusting and releasing heat to melt aluminum.

The first high temperature flue gas outlet 140 is connected to the dust-removing and heat-exchanging chamber 200 by pipelines for delivering about 70% (in volume) of the flue gas produced by combustion into the dust-removing and heat-exchanging chamber 200. The second high temperature flue gas outlet 150 is connected to the mixer 500 by pipelines for delivering about 30% (in volume) of the flue gas produced by combustion into the mixer 500. The oxygen content in the flue gas discharged from the furnace body 100 can be about 3% in volume, and the temperature of the flue gas is about 1000° C.

The dust-removing and heat-exchanging chamber 200 is provided between the furnace body 100 and the porous injection pipe heat exchanger 300 and is underground. The dust-removing and heat-exchanging chamber 200 is comprised of a dust-contained flue gas inlet 210 and a dust-removed flue gas outlet 220 which are provided on the top portion. The high temperature flue gas is delivered from the first high temperature flue gas outlet 140 of the furnace body 100 into the inner portion of the dust-removing and heat-exchanging chamber 200 through the dust-contained flue gas inlet 210 of the dust-removing and heat-exchanging chamber 200. The flue gas flows along an approximate U-shaped path in the dust-removing and heat-exchanging chamber 200, in order to remove most dust. During this process, the flue gas is cooled to a certain degree, of which the temperature is reduced to about 900° C., and then is discharged from the dust-removed flue gas outlet 220.

As shown in FIGS. 1 and 2, the porous injection pipe heat exchanger 300 is connected to the downstream of the dust-removing and heat-exchanging chamber 200 and is comprised of a high temperature flue gas inlet 310, a low temperature flue gas outlet 320, a low temperature air inlet 330, a high temperature air outlet 340, a flue gas passage 350 and an air passage 360. In the porous injection pipe heat exchanger 300, heat is exchanged between ambient air and high temperature flue gas, in order to preheat the air and reduce the temperature of the flue gas significantly. The dust-removed flue gas outlet 220 of the dust-removing and heat-exchanging chamber 200 is connected to the high temperature flue gas inlet 310 of the porous injection pipe heat exchanger 300 by pipelines, in order to deliver the high temperature flue gas with the temperature of about 900° C. into the high temperature flue gas inlet 310. After exchanging heat, the flue gas with the temperature of about 150° C. will be discharged to a chimney through the low temperature flue gas outlet 320 of the porous injection pipe heat exchanger 300.

The high pressure fan 400 is connected to the porous injection pipe heat exchanger 300 by pipelines, in order to pressurize the ambient air and deliver the pressurized air into the porous injection pipe heat exchanger 300. After being preheated in the porous injection pipe heat exchanger 300 and mixed in the mixer 500, the air will finally be delivered to the first combustion nozzle 120 and the second combustion nozzle 130 to support combustion. In particular, the high pressure fan 400 is connected to the low temperature air inlet 330 of the porous injection pipe heat exchanger 300 by pipelines, the high pressure air from the high pressure fan 400 enters the porous injection pipe heat exchanger 300 through the low temperature air inlet 330. Before entering the low temperature air inlet 330, the temperature of the air is about 20° C., while after passing the porous injection pipe heat exchanger 300, the temperature of the air increases to about 700° C. and the oxygen content thereof is about 21% in volume.

A detailed structural illustration of the porous injection pipe heat exchanger 300 is shown in FIG. 2. The porous injection pipe heat exchanger 300 is preferably made of carbon steel, and stainless steel is also applicable. As an optional embodiment of the present invention, the cross-section shape of the flue gas passage 350 is circular, while in other embodiments, it's also possible that the cross-section shape of the flue gas passage 350 is square, rectangle and the other. One end of the flue gas passage 350 is formed into the high temperature flue gas inlet 310, while the other end formed into the low temperature flue gas outlet 320. The high temperature flue gas flows in the flue gas passage 350.

The structure of the air passage 360 will be described in detail as follows. In one embodiment of the present invention, the air passage 360 is comprised of a first heat-exchanging cylinder 361, a second heat-exchanging cylinder 363 and a third heat-exchanging cylinder 365 which are provided in the flue gas passage 350 in sequence along the flue flowing direction. Furthermore, a first connecting passage 362 is included for connecting the first heat-exchanging cylinder 361 and the third heat-exchanging cylinder 365 end to end along the air flowing direction, and a second connecting passage 364 is also included for connecting the third heat-exchanging cylinder 365 and the second heat-exchanging cylinder 363 end to end along the air flowing direction. In this unlimited embodiment, an intake chamber 367 connected to the head end of the first heat-exchanging cylinder 361 and an outtake chamber 368 connected to the tail end of the second heat-exchanging cylinder 363 are further provided. Wherein, the low temperature air inlet 330 of the porous injection pipe heat exchanger 300 is provided on the chamber wall of the intake chamber 367, while the high temperature air outlet 340 of the porous injection pipe heat exchanger 300 is provided on the chamber wall of the outtake chamber 368.

As shown in FIG. 2, the first and third heat-exchanging cylinders 361 and 365 of the air passage 360 are similar with the second heat-exchanging cylinder 363 in structure, that is, all these three cylinders are in the form of straight cylinder and extend into the inner portion of the pipe wall of the flue gas passage 350. Both the first and second connecting passages 362 and 364 of the air passage 360 are provided outside the pipe wall of the fuel gas passage 350. The first heat-exchanging cylinder 361 is connected to the third heat-exchanging cylinder 365 by the bending first connecting passage 362, and the third heat-exchanging cylinder 353 is connected to the second heat-exchanging cylinder 363 by the second connecting passage 364. Each of the first, second and third heat-exchanging cylinders 361, 363, and 365 comprises a porous injection pipe 366.

The construction of each heat-exchanging cylinder is described as follows by taking the first heat-exchanging cylinder 361 as example. The first heat-exchanging cylinder 361 is comprised of a head end that is adjacent to the intake chamber 367 and a tail end that is adjacent to the first connecting passage 362. Wherein, the tail end is formed into an open end and connected to the first connecting passage 362 directly. The head end is formed into circular end wall and with an intake hole 3661 in the center. The porous injection pipe 366 is extended around the intake hole 3661 from the head end to the tail end in the first heat-exchanging cylinder 361. The porous injection pipe 366 is comprised of a closed end 3662 that is adjacent to the first connecting passage 362 and a pipe body 3663 that is extended between the intake hole 3661 and the closed end 3662.

Several air apertures 36631 are provided on the pipe body 3663, such that after the high pressure cold air from the low temperature air inlet 330 enters the pipe body 3663 from the intake chamber 367 through the intake hole 3661, the air is injected towards the inner wall of the first heat-exchanging cylinder 361 through the several air apertures 36631 under high speed. By quick heat exchanging with the high temperature flue gas that flows along the outer wall of the first heat-exchanging cylinder 361, the air is preheated quickly and the first heat-exchanging cylinder 361 is cooled in a timely manner. As such, it solves the problem that the first heat-exchanging cylinder 361 may be damaged by high temperature flue gas for long time. Therefore, the first heat-exchanging cylinder 361 according to the present invention can be made of carbon steel that is poorer in heat resistance but lower in cost than stainless steel.

Since the ambient air enters the porous injection pipe heat exchanger 300 after being pressurized by the high pressure fan 400, when enters the porous injection pipe 366 through the intake hole 3661, the high pressure air will be injected outwards from the porous injection pipe 366 through the air apertures 36631 under high speed, impacting the inner wall of the first heat-exchanging cylinder 361 with high speed and high pressure. By such high speed and high pressure impact, the heat-exchanging between the low temperature air inside the first heat-exchanging cylinder 361 and the high temperature flue gas outside the first heat-exchanging cylinder 361 can be conducted quickly and effectively, which can improve the heat-exchanging effect of the waste heat utilization of the high temperature flue gas in the aluminum melting furnace. When producing the porous injection pipe heat exchanger 300 with carbon steel, the above-mentioned process is capable of quickly reducing the temperature of the high temperature fuel gas to an acceptable range for the carbon steel, in order to make the porous injection pipe heat exchanger 300 with carbon steel be enforceable. While as for the porous injection pipe heat exchanger 300 that is made of stainless steel, the temperature of the high temperature flue gas is also reduced quickly and effectively, prolonging the service life of the stainless steel made parts significantly.

The structure and operating process of the porous injection pipe 306 are described above by taking the first heat-exchanging cylinder 361 as example. In this unlimited embodiment, the construction and working principle for the second and third heat-exchanging cylinders 363 and 365 will be omitted since they have the same structures as that of the first heat-exchanging cylinder.

The above-mentioned components are interconnected to form the bending air passage 360, that is to say, the first connecting passage 362 is connected between the first heat-exchanging cylinder 361 and the third heat-exchanging cylinder 365, and the second connecting passage 364 is connected between the third heat-exchanging cylinder 365 and the second heat-exchanging cylinder 363. After entering the porous injection pipe heat exchanger 300 from the low temperature air inlet 330, the air passes the intake chamber 367, the first heat-exchanging cylinder 361, the first connecting passage 362, the third heat-exchanging cylinder 365, the second connecting passage 364, the second heat-exchanging cylinder 363, the outtake chamber 368 in sequence, and finally into the inner portion of the mixer 500 through the high temperature air outlet 340.

As shown in FIG. 2, the flue gas flowing direction in the flue gas passage 350 of the porous injection pipe heat exchanger 300 is perpendicular to the air flowing direction in the several heat-exchanging cylinders of the air passage 360, in order to achieve the effect of the fast and effective heat exchanging between the flue gas and the air.

Figure 3:
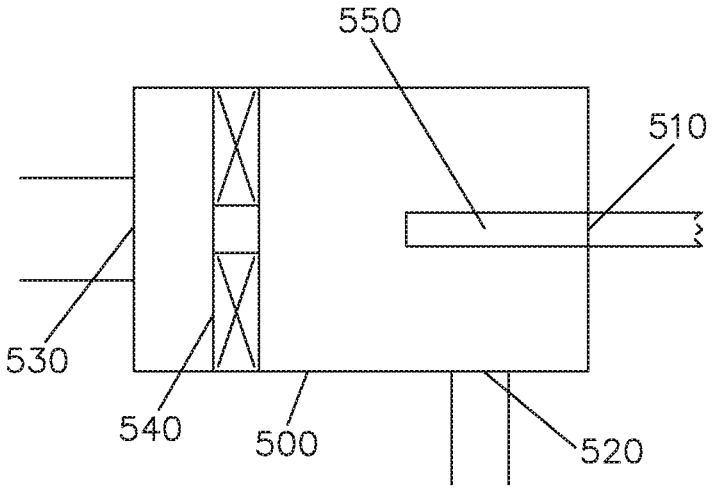
FIG. 3 shows the constructional illustration of the mixer according to the present invention.

Now refer to FIG. 3, a mixer 500 is comprised of a high temperature air inlet 510, a back-flow flue gas inlet 520, a mixed gas outlet 530 and impellers 540. The second high temperature flue gas outlet 150 of the furnace body 100 is connected to the back-flow flue gas inlet 520 of the mixer 500 by conduits, in order to deliver a part of the high temperature flue gas into the mixer 500. While the high temperature air outlet 340 of the porous injection pipe heat exchanger 300 is connected to the high temperature air inlet 510 of the mixer 500 by conduits, in order to deliver the high temperature air into the mixer 500 after heat exchanging. Under the action of impellers 540, the high temperature flue gas and the high temperature air are fully mixed in the mixer 500 into mixed gas. The oxygen content of the mixed gas is about 12% in volume and the temperature thereof is about 900° C. The mixed gas outlet 530 of the mixer 500 is connected to the first and second combustion nozzles 120 and 130 by conduits, in order to deliver the mixed gas to the first and second combustion nozzles 120 and 130 for combusting and heat-releasing.

The mixer 500 is also comprised of an injecting pipe 550 that extends inwards from the high temperature air inlet 510. The high temperature and high pressure air from the porous injection pipe heat exchanger 300 is injected into the mixer 500 through the injecting pipe 550, causing negative pressure to be formed on one side in the mixer 500 adjacent to the high temperature air inlet 510, thereby a part of the high temperature fuel gas from the furnace body 100 is inhaled into the mixer 500. Combustion-supporting mixed gas is thus formed and back-flowed to the first and second combustion nozzles 120 and 130 for low oxygen combustion with the fuel gas from the fuel gas conduit (not shown).

Although the preferred embodiments of the present invention have been described in detail herein, it is understood that the present invention is not limited to the detailed description and the illustrative specific structures. The skilled in the art will be able to implement other variations and amendments thereof without departing from the nature and scope of the present invention. For example, providing a waste heat recovery boiler downstream of the porous injection pipe heat exchanger along the flue gas flowing direction, in order to make further use of the waste heat of the flue gas to heat the hot water; or making the first, second and third heat-exchanging cylinders with different materials, for example, the first heat-exchanging cylinder being made of stainless steel with good heat resistance while the second and third heat-exchanging cylinders being made of carbon steel with lower cost. Furthermore, the parameters such as temperature or pressure value throughout the system should be properly selected based on the particular operating conditions in the disclosed scope of the present invention.

The invention claimed is:

1. A continuous low oxygen and high temperature combustion aluminum melting furnace with porous injection pipe heat exchanger, comprising:

a furnace body that is comprised of an aluminum melting tank provided inside the furnace body, a combustion chamber provided inside the furnace body and above the aluminum melting tank, and a first high temperature flue gas outlet located on one end wall of the furnace body and connected to the combustion chamber;

at least one combustion nozzle provided on the other end wall of the furnace body for injecting fuel and combustion-supporting gas into the combustion chamber, in order to generate heat in the combustion chamber and melt an aluminum bar in the aluminum melting tank into molten aluminum;

a flue gas piping connected to the first high temperature flue gas outlet of the furnace body to a chimney; and a high temperature heat exchanger provided in the flue gas piping to make use of the waste heat of the flue gas for preheating air;

wherein, the high temperature heat exchanger is a porous injection pipe heat exchanger comprised of a flue gas passage and at least one heat-exchanging cylinder that is provided in the flue gas passage, the at least one heat-exchanging cylinder is comprised of a head end that is formed into a circular end wall and with an intake hole in the center, a tail end that is formed into an open end, and a porous injection pipe that extends around the intake hole from the head end to the tail end in the at least one heat-exchanging cylinder, wherein cold air enters the porous injection pipe heat exchanger through the intake hole and the preheated high temperature air flows out of the porous injection pipe heat exchanger through the tail end, and the porous injection pipe is comprised of a closed end that is adjacent to the tail end and a pipe body that extends between the intake hole and the closed end, a plurality of air apertures are provided on the peripheral wall of the pipe body, such that the cold air that enters the at least one heat-exchanging cylinder through the intake hole is injected towards the inner wall of the at least one heat-exchanging cylinder through the plurality of air apertures, in order to conduct fast heat exchange with the high temperature flue gas that flows along the outer wall of the at least one heat-exchanging cylinder, and maintain the temperature of the at least one heat-exchanging cylinder below the calibration heat-resisting temperature of the manufacturing material thereof, and the porous injection pipe heat exchanger is specifically comprised of a first heat-exchanging cylinder, a second heat-exchanging cylinder and a third heat-exchanging cylinder which are provided in the flue gas passage in sequence along the flue gas flowing direction, the porous injection pipe heat exchanger is also comprised of a first connecting passage and a second connecting passage which are provided outside the flue gas passage, the first heat-exchanging cylinder is connected to the third heat-exchanging cylinder end to end along the air flowing direction by the first connecting passage, and the third heat-exchanging cylinder is connected to the second heat-exchanging cylinder end to end along the air flowing direction by the second connecting passage, wherein the cold air enters the first heat-exchanging cylinder through the intake hole of the first heat-exchanging cylinder and then passes the first connecting passage, the third heat-exchanging cylinder, the second connecting passage and the second heat-exchanging cylinder, then the preheated high temperature air flows out the porous injection pipe heat exchanger through the tail end of the second heat-exchanging cylinder.

2. The continuous low oxygen and high temperature combustion aluminum melting furnace with porous injection pipe heat exchanger according to claim 1, wherein the porous injection pipe heat exchanger is further comprised of an intake chamber that is provided outside the flue gas passage and connected to the head end of the first heat-exchanging cylinder and an outtake chamber that is provided outside the flue gas passage and connected to the tail end of the second heat-exchanging cylinder, a low temperature air inlet of the porous injection pipe heat exchanger is formed on the chamber wall of the intake chamber, a high temperature air outlet of the porous injection pipe heat exchanger is formed on the chamber wall of the outtake chamber, a high temperature flue gas inlet is formed on one end of the flue gas passage of the porous injection pipe heat exchanger that is adjacent to the first heat-exchanging cylinder, and a low temperature flue gas outlet is formed on the other end of the flue gas passage of the porous injection pipe heat exchanger that is adjacent to the third heat-exchanging cylinder.

3. The continuous low oxygen and high temperature combustion aluminum melting furnace with porous injection pipe heat exchanger according to claim 2, wherein a dust-removing and heat-exchanging chamber is provided in the flue gas piping and upstream of the porous injection pipe heat exchanger along flue gas flowing direction, the dust-removing and heat-exchanging chamber is comprised of a dust-contained flue gas inlet and a dust-removed flue gas outlet which are spaced on the top portion thereof, the dust-contained flue gas inlet is connected to the first high temperature flue gas outlet of the furnace body, and the dust-removed flue gas outlet is connected to the high temperature flue gas inlet of the porous injection pipe heat exchanger.

4. The continuous low oxygen and high temperature combustion aluminum melting furnace with porous injection pipe heat exchanger according to claim 1, wherein a high pressure fan is provided for delivering pressurized cold air into the porous injection pipe heat exchanger.

5. The continuous low oxygen and high temperature combustion aluminum melting furnace with porous injection pipe heat exchanger according to claim 1, wherein two combustion nozzles are provided on the other end wall of the furnace body at intervals.

6. The continuous low oxygen and high temperature combustion aluminum melting furnace with porous injection pipe heat exchanger according to claim 1, wherein the at least one heat-exchanging cylinder is made of carbon steel.

* * * * *